United States Patent [19]

Long

[11] 4,341,050

[45] Jul. 27, 1982

[54] CONSTRUCTION MODULE

[76] Inventor: Leonard L. Long, 2025 Peachtree Rd., NE., Suite 7, Atlanta, Ga. 30309

[21] Appl. No.: 199,846

[22] Filed: Oct. 23, 1980

Related U.S. Application Data

[63] Continuation of Ser. No. 23,261, Mar. 23, 1979, abandoned.

[51] Int. Cl.[3] ..... E04C 1/10

[52] U.S. Cl. ..... 52/589; 138/111; 138/115; 285/184; 52/726

[58] Field of Search ..... 52/589–594, 52/726, 218, 219, 603, 606, 608, 286, 504, 505, 569, 563; 138/111, 115, 155; 98/58; 285/184

[56] References Cited

U.S. PATENT DOCUMENTS

| | | | |
|---|---|---|---|
| 708,499 | 9/1902 | Searight et al. | 52/595 |
| 903,907 | 11/1908 | Soss | 52/594 |
| 1,197,815 | 9/1916 | Frost | 52/603 |
| 1,365,162 | 1/1921 | Ferguson | 52/595 |
| 1,552,077 | 9/1925 | Palanti | 52/286 |
| 2,221,416 | 11/1940 | Tau | 52/606 |
| 2,271,030 | 1/1942 | Palanti | 52/606 |
| 2,994,162 | 8/1961 | Frantz | 52/595 |
| 3,116,570 | 1/1964 | Torricelli | 52/593 |
| 3,305,982 | 2/1967 | Steele | 52/593 |
| 3,873,225 | 3/1975 | Jakobsen et al. | 52/604 |

FOREIGN PATENT DOCUMENTS

| | | | |
|---|---|---|---|
| 831304 | 2/1952 | Fed. Rep. of Germany | 52/219 |
| 261571 | 8/1949 | Switzerland | 52/271 |

*Primary Examiner*—James L. Ridgill, Jr.

*Attorney, Agent, or Firm*—Newton, Hopkins & Ormsby

[57] ABSTRACT

A masonry construction module is provided which possesses versatility in the formation of various types of structures. The module has corrugations on all of its side walls which interfit complementally with the corrugations of adjacent modules in a horizontal course, thus rendering the courses of modules self-aligning and interlocked. The opposite ends of the module are respectively recessed and step projected to promote self-alignment and interlocking with modules in courses above and below. Sloping end shoulder surfaces shed water and form a barrier to water, sight and sound. The modules are designed to be laid up without mortar but can be laid up with mortar if desired and core openings can accept concrete reinforced with metal or the like to integrate structures. The corrugated side surfaces also provide ideal adhesion with stucco and the like.

11 Claims, 10 Drawing Figures

CONSTRUCTION MODULE

This is a continuation, of application Ser. No. 23,261, filed Mar. 23, 1979, now abandoned.

CROSS-REFERENCE TO RELATED APPLICATION

This application contains subject matter disclosed in Design patent application Ser. No. 654, filed Jan. 2, 1979, for MODULAR BUILDING UNIT, Leonard L. Long, inventor.

BACKGROUND OF THE INVENTION

The invention is an improvement on the construction module or unit disclosed in U.S. Pat. No. Des. 198,527 of June 30, 1964, issued to Leonard D. Long. In addition to the unit shown on the Long design patent, a variety of interlocking construction blocks or modules is known in the prior art. Some examples of the patented prior art are contained in the following United States patents which are made of record herein under 37 C.F.R. 1.56:

U.S. Pat. Nos. 708,499, 2,994,162, 903,907, 3,116,570, 1,365,162, 3,305,982, 1,552,077, 3,873,225, 2,221,416, 4,035,975, Des. 213,686

None of the known prior art building modules has positive interlocking and self-aligning means on all side surfaces as well as on the opposite end faces thereof, and none possesses the unique arrangement of vertical corrugations on the side surfaces in accordance with the present invention, which corrugations interfit complementally and lockingly in a variety of arrays of the modules.

A notable feature of this invention also absent in the prior art is the provision on the top and bottom end faces of each module of concentrically arranged steeply and gently sloping surfaces which shed water and resist water penetration through the structure while simultaneously cooperating in the alignment and interlocking of modules in adjacent courses above and below. The upper and lower end faces of the module also possess interlocking keys which also serve as barriers to water, sight and sound.

Other features and advantages of the invention will appear to those skilled in the art during the course of the following description.

DETAILED DESCRIPTION

Figure 1:
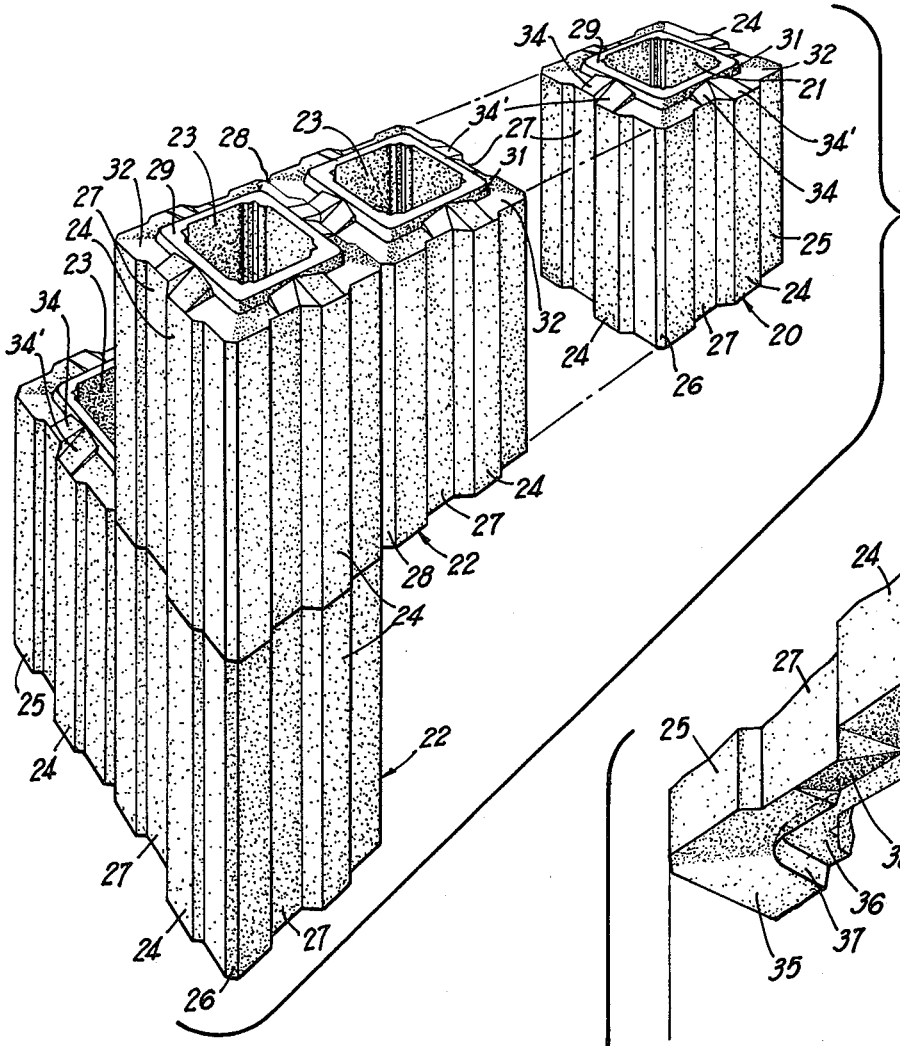
FIG. 1 is a partly exploded perspective view of assembled construction modules in accordance with the invention.

Referring to the drawings in detail, wherein like numerals designate like parts, the numeral 20 in FIG. 1 designates a construction module or block in accordance with the invention which is generally rectangular and provided centrally with a single modified rectangular end-to-end through opening 21, the axis of which is normally disposed vertically in the use of the module 20 to form structures. Also in FIG. 1, a second module 22 according to the invention is depicted, namely a double module in comparison to the single module 20 and including a pair of spaced parallel vertical axis through openings 23, each of the openings 21 and 23 being of the same size and cross sectional shape. The single and double modules 20 and 22 are of equal height and equal thickness or width in one direction, but the double module 22 is twice the width of a single module in the other direction or across the axes of the two openings 23.

Figure 3:
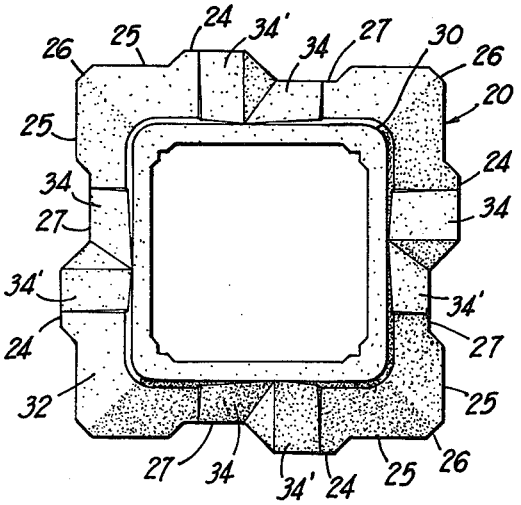
FIG. 3 is a top plan view of a single module in accordance with the invention.

Each single module 20 is corrugated or ribbed on all of its side walls. Referring to FIG. 3, one projecting rib 24 is formed on each side wall and extends from top to bottom of such side wall and is outwardly tapering in transverse cross section from the adjacent flat marginal face 25 of the particular side wall of the module. Each projecting rib 24 is unequally spaced from the adjacent corners of the module which are beveled as at 26. Progressing clockwise in FIG. 3, each rib 24 is spaced an equal distance from the corner 26 rearwardly thereof. The four ribs 24, therefore, are spaced apart equidistantly circumferentially of the module 20 as viewed from the end thereof, FIG. 3.

Figure 6:
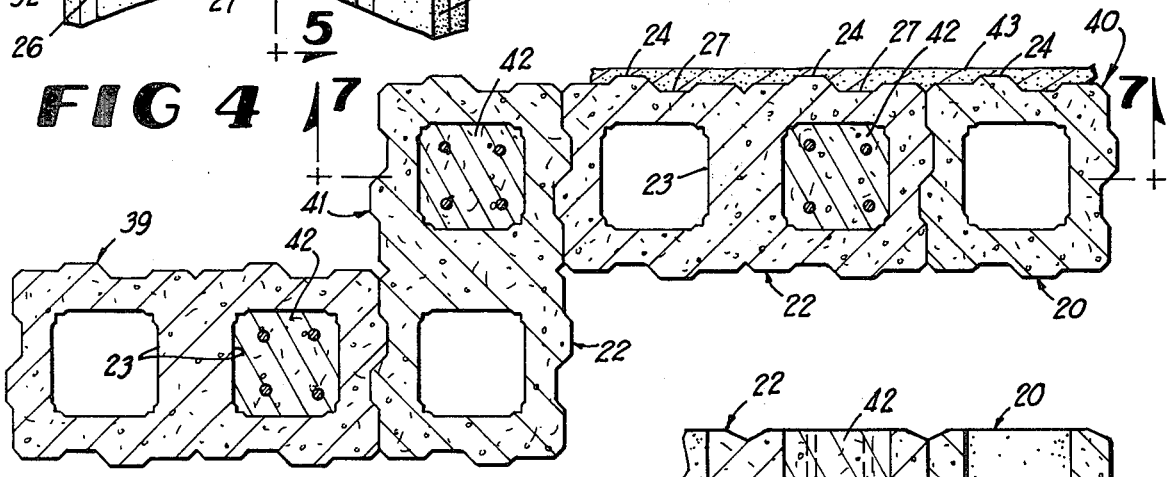
FIG. 6 is a horizontal cross section taken through a course of modules according to the invention in a typical wall structure.

Immediately following each projecting rib 24, the adjacent side wall has a recess or valley 27 which tapers inwardly in cross section oppositely from the taper of the adjacent rib 24. The outer surfaces of the ribs 24 are flat and the inner surfaces of the recesses 27 are flat. The recesses 27 are equidistantly spaced circumferentially from each other, and are unequally spaced like the ribs 24 from the two corners 26 forming the terminals of a given side wall of the module. The several ribs 24 and recesses 27, together with the corner portions of the module, form a regular corrugated or relief surface externally on all side walls of the module. When any two side surfaces of adjacent modules 20 or 22 are placed in abutment as in a wall course or other structure array, the vertical ribs 24 are adapted to interfit closely and lockingly in opposing vertical recesses 27 of the next adjacent module, as best shown in FIG. 6. Thus, the corrugated side walls form accurate alignment means for the building modules in various structures, and also form interlocking or rigid keying means for the modules.

The described arrangement of ribs 24 and recesses 27 on the single module 20 is basically identical on each double width module 22 which is simply the equivalent of one side-by-side pair of single modules 20 integrally joined at abutting side surfaces. On its opposite longer side surfaces, each double module 22 has a continuous top-to-bottom vertical V-groove 28 formed therein to simulate an adjacent pair of the beveled corners 26 of two side-by-side single modules 20.

Figure 2:
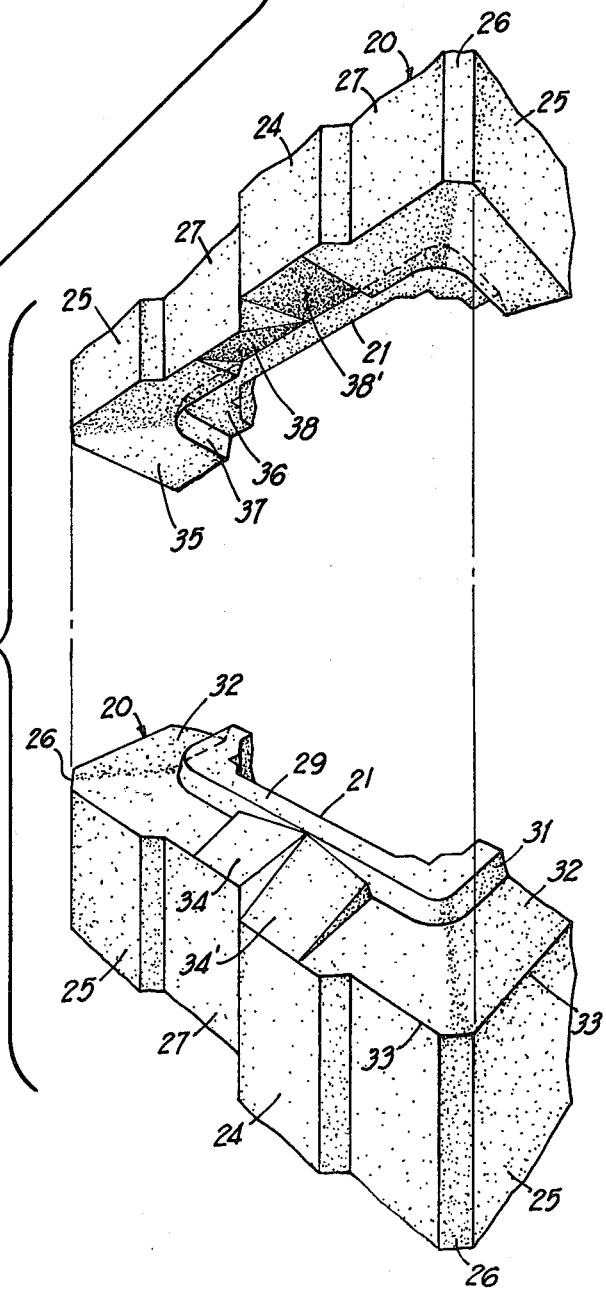
FIG. 2 is a fragmentary exploded perspective view depicting the top end of one module and the bottom end of an adjacent module.

Each single or basic module 20 has a male end face as depicted in FIGS. 2 and 3 and an opposite female end face shown partially in FIG. 2 and elsewhere in the drawings. The male end face comprises a central uniform height inner shoulder 29 or shallow wall immediately surrounding the rectangular core opening 21 and including rounded corners 30. The flat end face of this shoulder 29 forms the surface of maximum elevation on each module 20 when the same is arranged upright in a structural array as depicted in FIG. 1.

The outer marginal surface of the rectangular shoulder 29 indicated at 31 in the drawings is steeply inclined for a reason to be set forth. Immediately outwardly of this inclined surface 31 at a slightly lower elevation beginning at the base of shoulder 29 is a considerably less abruptly inclined surface or shoulder 32 extending entirely around the end face of the module 20. The outer margin of the inclined shoulder 32 forms a corner junction with the four corrugated side faces of the module, such junction being indicated by the numeral 33 in FIG. 2.

The male end face of each module further comprises on each of the four sides thereof a dual elevation or stepped alignment and locking key 34, 34'. Both portions of each dual locking key 34, 34' are inclined relative to each other and to the adjacent shoulder surface 32 with different degrees of inclination. Each dual key 34, 34' is centered on the adjacent side face of the module 20. Each key portion 34' has its outer margin forming a junction with the outer flat vertical face of one rib 24, and the corresponding key portion 34 has its outer margin forming a junction with the base surface of a vertical recess 27, the arrangement being clearly shown in FIGS. 2 and 3.

Figure 4:
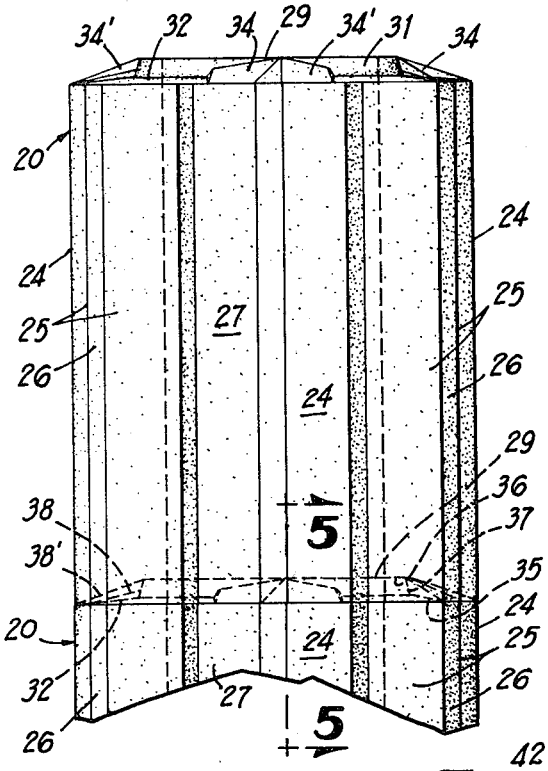
FIG. 4 is a fragmentary side elevation of a pair of stacked modules as used in a wall structure and showing the interfitting relationship of their opposing end faces.
Figure 5:
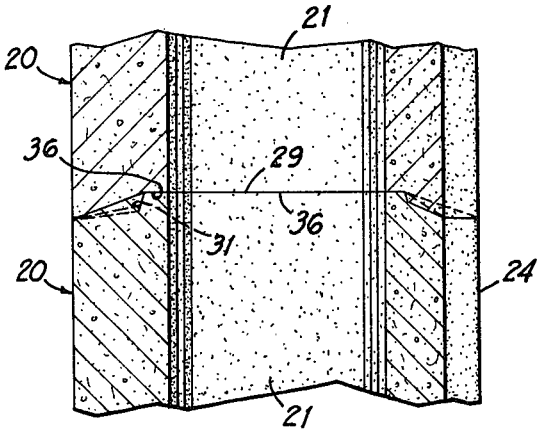
FIG. 5 is a fragmentary vertical section taken on line 5—5 of FIG. 4.

The opposite female end face of each module 20 can be termed a mechanical relief negative of the male end face described above. That is to say, with particular reference to FIG. 2, the female end face of the module 20 disposed lowermost in the drawings has a concave relatively wide inclined lowermost surface 35 whose inclination matches that of the shoulder surface 32 so that these two surfaces 35 and 32 may nest interlockingly when two modules are stacked in a structural array, as in FIGS. 1, 4 and 5.

Immediately inwardly of the concave female end face 35 is a generally rectangular recess 36, having a steeply inclined uniform height marginal wall 37 which matches the inclination of the inclined surface 31 and receives the same snugly in interfitting and interlocking relationship on all sides of the stacked modules. The floor of the recess 36 is flat for substantial abutment with the flat end face of rectangular shoulder 29 when the modules are stacked as in FIGS. 4 and 5. On each of the four sides of the female end face of each module 20, dual stepped inclined keying surfaces 38, 38' are provided, FIG. 2, which surfaces are the relief negative of the dual key 34, 34' which they engage lockingly in assembled relationship, as in the construction of a wall or the like. In essence, each male end face of a module 20 is adapted to enter a female end face of an adjacent module for the automatic alignment and structural interlocking of the two modules in end-to-end relationship, so that they cannot rotate around the axis of the through opening 21 or be displaced laterally of such axis in any direction. As shown best in FIG. 1, each double construction module or block 22 has a pair of male end face portions which are individually identical to the male end face of each single module 20. Each male end face portion on the double module 22 is adapted to nest or socket within one female end face of the single module 20. In other cases, the two male end face portions of a double module 22 may be socketed in two corresponding female end face portions of another double module or block. In this latter connection, each double module 22 at its lower end, FIG. 1, has two female end face portions which are individually identical to the female end face of the single module 20.

The versatile utility of the construction module in single or double units is exemplified in FIGS. 1, 6 and 8 through 10. In FIG. 6, a wall is illustrated including offset parallel sections 39 and 40 intervened by a short right angular connecting portion 41 which may be laid up from a series of stacked double modules 22. The wall section 40, as illustrated, is formed by laying up in side-by-side engaged relationship double and single modules 22 and 20.

Figure 7:
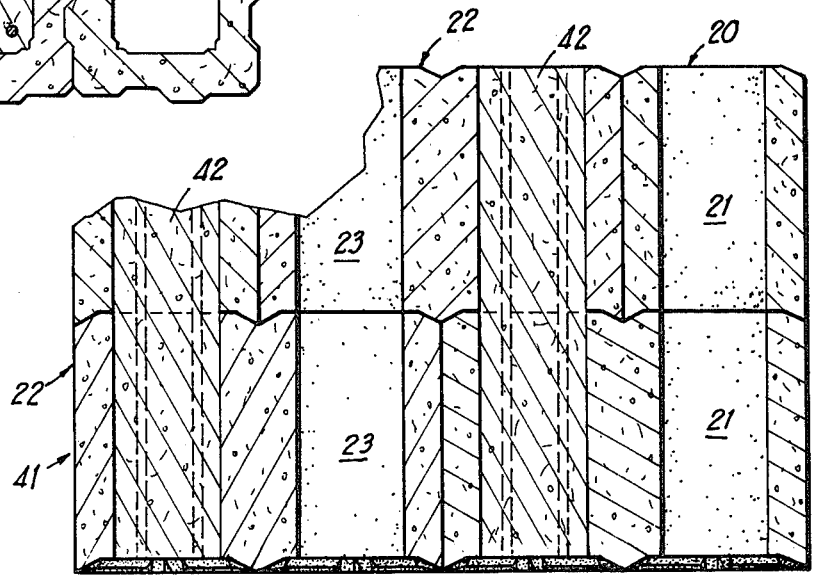
FIG. 7 is a fragmentary vertical section through a portion of the course taken on line 7—7 of FIG. 6.

Also shown in FIG. 6 and in FIG. 7 is the capability of filling selected vertical passages in the wall structure formed by the openings 21 or 23 with steel reinforced concrete masses 42 to soundly integrate the particular wall or structure composed of the modules.

Another capability of the invention shown in FIG. 6 is the utilization of the corrugated or ribbed module side faces for superior bonding with a facing of stucco 43 or the like. The increased surface area available for bonding because of the relief surface enables the use of a thinner layer of stucco with success, which is an economic advantage in the invention.

FIG. 7 shows the locking action of the reinforced concrete masses 42 in a wall structure, and this figure also illustrates that successive courses of modules are laid up in overlapping relationship to thereby interlock each module with an adjacent upper, lower and side module in a given course. It has already been explained that modules can be laid with or without mortar.

The arrangement of the steeply and less steeply inclined surfaces 31 and 32 and 35 and 37 in a wall or the like formed by the invention affords multiple advantages in addition to self-alignment and interlocking of modules. The interengaging sloping surfaces of the male and female end faces form a barrier against driving rain and cause a natural drainage of water outwardly and downwardly from the interface of stacked modules. The rectangular shoulder 29 is a part of this barrier. The described stepped dual keys 34, 34' at each side of each module act further as a water seal and as a barrier to sight and sound. All of the described features coact mutually to provide a superior and more efficient construction module in the overall and one having maximum versatility in construction.

Figure 8:
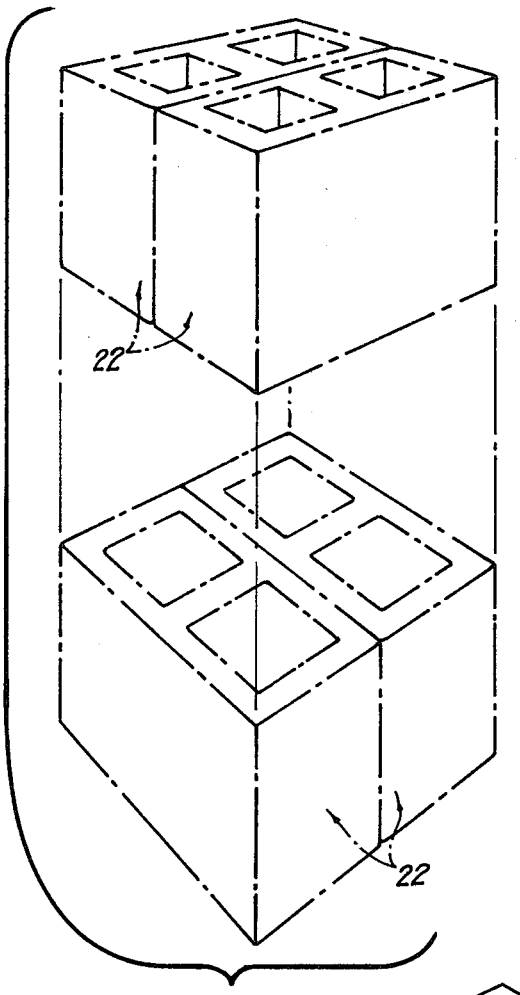
FIGS. 8 through 10 are schematic views in perspective of various columns or pilasters which can be constructed using various arrays of modules in accordance with the invention in the courses thereof.
Figure 9:
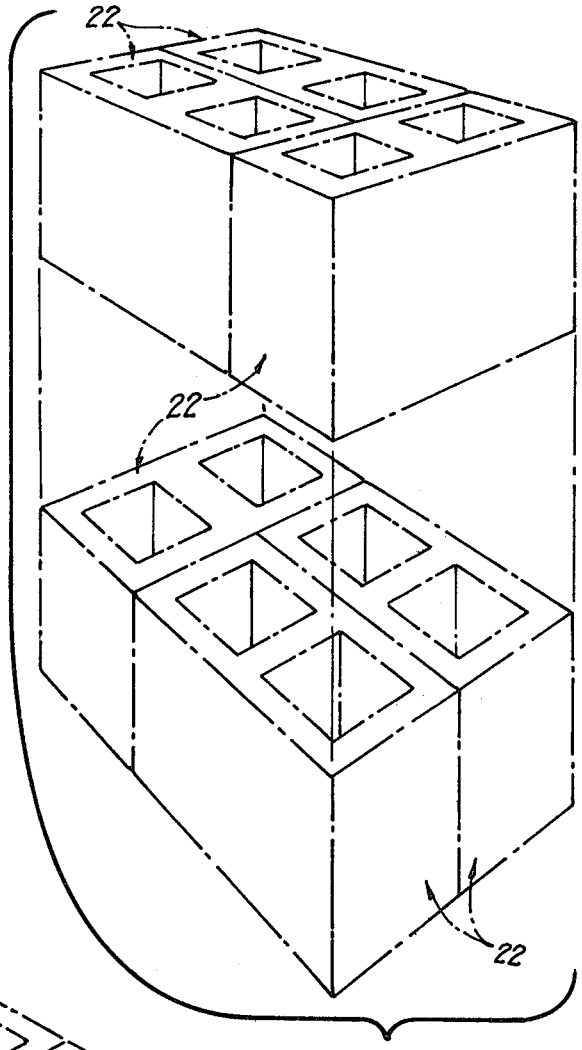
Figure 10:
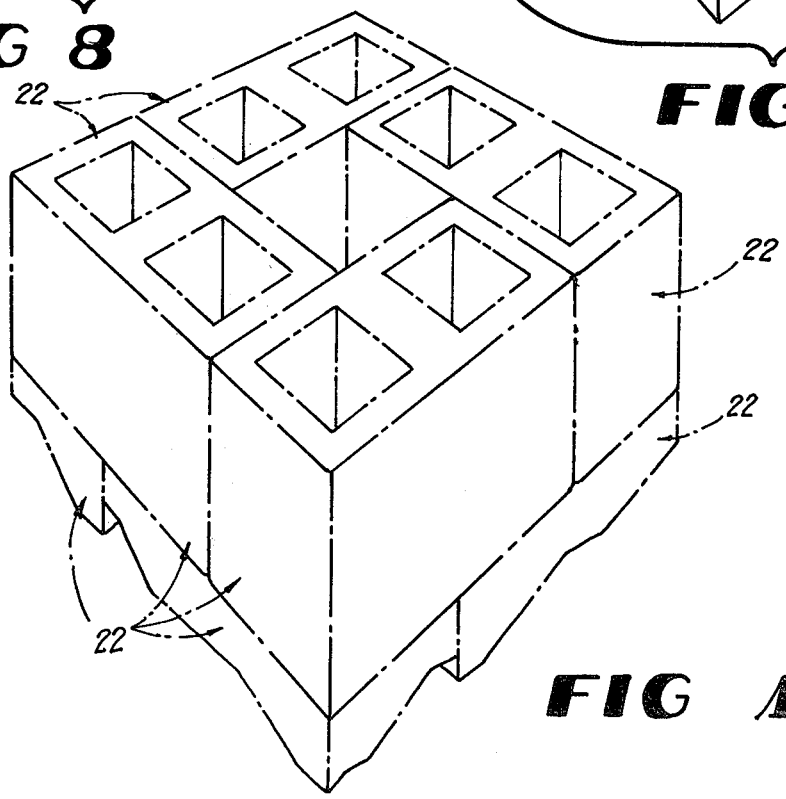

The use versatility of the invention to some extent is shown in schematic drawing FIGS. 8 through 10. For example, FIG. 8 shows the formation of a column or pilaster wherein two of the double modules 22, above-described, are utilized in each course with the modules of successive courses rotated 90 degrees relative to those above and below a given course. This produces a staggered overlapping relationship with full interlocking engagement of all opposing side faces and top and bottom end faces, as described in detail. The interlocking male and female end faces are completely symmetrical in terms of 90 degree rotations of modules in successive courses when building a column or any other structure.

FIG. 9 schematically shows the construction of a column or pilaster utilizing three of the modules 22 in each course. One pair of modules in each course are side-by-side and parallel with the third module across corresponding shorter side faces so that the corrugations of the three modules are interlocked. Also in FIG. 9 the three module array of successive courses is rotated 180 degrees between adjacent courses so that in each course the single crossing module will rest on the two side-by-side modules below, and the two side-by-side modules 22 above will rest partially on the single module below.

FIG. 10 shows a column construction in which four modules 22 per course are employed with full interlocking of all abutting vertical corrugated side faces and engaging male and female end faces. Also in FIG. 10 the module array in each course is rotated in relation to courses immediately above and below to form desirable course overlaps without any loss of interlocking engagement.

In view of the foregoing detailed description, the many significant improvements of the invention over the prior art and the increased versatility of usage should now be recognized by those skilled in the art without further description.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A construction module in the general form of a rectangular parallelepiped including side faces which are arranged upright in use and are corrugated for interlocking engagement with the corrugations of like modules in a structure, and the module having male and female end faces, the female end face comprising the relief negative of the male end face, whereby opposing male and female end faces of plural modules in stacked relationship in a structure may interfit in positively locked relationship, the male and female end faces of the module including concentrically arranged inner and outer shoulder surfaces extending continuously around the margin of the module with the inner shoulder surface being substantially rectangular and the outer shoulder surface extending to and joining said corrugated side faces of the module, each corrugated side face of the module having at least one rib projecting from the normal plane of the side face and at least one adjacent recess parallel to the rib and being formed inwardly from the normal plane of the side face with the outer surface of said rib and the inner surface of said recess being flat, and the module having a flat end face normal to said side faces at each opposite end thereof, and defining planes of maximum projection of the male end face of the module and maximum relief for the female end face of the module so that said module provides positive interlocking and self-aligning means on all side surfaces as well as on the opposite end faces thereof that present a flat abutment surface.

2. A construction module in the general form of a rectangular parallelepiped including side faces which are arranged upright in use and are corrugated for interlocking engagement with the corrugations of like modules in a structure, and the module having male and female end faces including key elements, the female end face comprising the relief negative of the male end face, whereby opposing male and female end faces of plural modules in stacked relationship in a structure may interfit in positively locked relationship, the male and female end faces of the module including concentrically arranged inner and outer inclined shoulder surfaces extending continuously around the margin of the module with the outer inclined shoulder surface joining said corrugated side faces of the module, the inner inclined shoulder surface being more steeply inclined than the outer shoulder surface, both inclined shoulder surfaces presenting a barrier to the intrusion of water and tending to shed water, the inner inclined shoulder surface defining the outer side wall of a continuous raised projection on the male end face of the module, the projection having a flat end surface perpendicular to said side faces and defining a plane of maximum projection of the male end face, and the inner inclined shoulder surface defining the outer side wall of a continuous recess on the female end face of the module, said recess having a flat bottom surface parallel to said flat end surface of the projection and defining a plane of maximum relief for the female end face, and a pair of stepped inclined alignment and locking elements on the male and female end faces of the module adjacent to said side faces and being disposed outwardly of said inner inclined shoulder surface.

3. A construction module in the general form of a rectangular parallelepiped including side faces which are arranged upright in use and are corrugated for interlocking engagement with the corrugations of like modules in a structure, and the module having male and female end faces including key elements, the female end face comprising the relief negative of the male end face, whereby opposing male and female end faces of plural modules in stacked relationship in a structure may interfit in positively locked relationship, the male and female end faces of the module including concentrically arranged inner and outer inclined shoulder surfaces extending continuously around the margin of the module with the outer inclined shoulder surface extending to and joining said corrugated side faces of the module.

4. A construction module as defined in claim 3 having a central passage opening through said male and female end surfaces.

5. A construction module as defined in claim 1, and the inner inclined shoulder surface being more steeply inclined than the outer shoulder surface, both inclined shoulder surfaces presenting a barrier to the intrusion of water and tending to shed water.

6. A construction module as defined in claim 1, and the inner inclined shoulder surface defining the outer side wall of a continuous raised projection on the male end face of the module, the projection having a flat end surface perpendicular to said side faces and defining a plane of maximum projection of the male end face, and the inner inclined shoulder surface defining the outer side wall of a continuous recess on the female end face of the module, said recess having a flat bottom surface parallel to said flat end surface of the projection and defining a plane of maximum relief for the female end face.

7. A construction module as defined in claim 1, and the module having a flat end face normal to said side faces at each opposite end thereof, and defining planes of maximum projection of the male end face of the module and maximum relief for the female end face of the module.

8. A construction module as defined in claim 1, and interengageable projecting key element and key element receiving recesses respectively on the male and female end faces of said module.

9. A construction module as defined in claim 1, and said key element and key element receiving recesses being located on said outer inclined shoulder surfaces of the male and female end faces of the module.

10. A construction module as defined in claim 1, and said key element and key element receiving recesses being located substantially centrally relative to each side face of the module and each including a pair of stepped inclined surfaces of different degrees of inclination from said inner and outer inclined shoulder surfaces.

11. A construction module in the general form of a rectangular parallelepiped including side faces which are arranged upright in use and are corrugated for interlocking engagement with the corrugations of like modules in a structure, and the module having male and female end faces, the female end face comprising the relief negative of the male end face, whereby opposing male and female end faces of plural modules in stacked relationship in a structure may interfit in positively locked relationship, the male and female end faces of the module including inner and outer shoulder surfaces, the inner shoulder surface projecting upwardly from the outer shoulder surface and the outer shoulder surface extending outwardly from the inner shoulder surface and joining said corrugated side faces of the module, each corrugated side face of the module having at least one rib projecting from the normal plane of the side face and at least one adjacent recess parallel to the rib and being formed inwardly from the normal plane of the side face with the outer surface of said rib and the inner surface of said recess being flat, and the module having a shoulder with a flat end face normal to said side faces at each opposite end thereof, and defining planes of maximum projection of the male end face of the module and maximum relief for the female end face of the module so that said module provides positive interlocking and self-aligning means on all side surfaces as well as on the opposite end faces thereof that present a flat abutment surface.

* * * * *